US006022191A

United States Patent [19]

Moore et al.

[11] Patent Number: 6,022,191

[45] Date of Patent: Feb. 8, 2000

[54] FAN BLADE MOUNTING

[75] Inventors: R. David Moore; John D. Moore, both of Marceline; Joseph Parker, Keyesville; John E. Dowell; Kenneth E. Jay, both of Brookfield; John P. Haynes, Bucklin, all of Mo.

[73] Assignee: The Moore Company, Marceline, Mo.

[21] Appl. No.: 09/080,093

[22] Filed: May 15, 1998

[51] Int. Cl.[7] ..... F01D 5/30

[52] U.S. Cl. ..... 416/134 R; 416/140; 416/220 A; 416/221; 416/207; 416/210 R; 416/209; 416/205

[58] Field of Search ..... 416/132 A, 132 B, 416/133, 134 R, 135, 140, 219, 220, 220 A, 221, 207, 210 R, 211, 209, 239, 244 R, 500, 205; 403/109.1, 109.4, 110

[56] References Cited

U.S. PATENT DOCUMENTS

| | | | |
|---|---|---|---|
| 1,802,648 | 4/1931 | Heath . | |
| 2,990,018 | 6/1961 | Moore . | |
| 3,877,824 | 4/1975 | Jury | 403/174 |
| 5,035,576 | 7/1991 | Byrnes et al. | 416/134 R |

FOREIGN PATENT DOCUMENTS

| | | |
|---|---|---|
| 2 521 231 | 8/1983 | France . |
| 1165738 | 10/1969 | United Kingdom . |

OTHER PUBLICATIONS

Copy of International Search Report of PCT/US 99/10334.

Moore Fans, "High Efficiency Axial Flow Fan for air Cooled Heat Exchangers and Cooling Towers, Since 1940," brochure, Mar. 1996, 6 pp.

The Moore Company, "Engine Drive Fans Owner's Manual, Installation Maintenance Operation," Jul. 1996, pp. 1–15.

*Primary Examiner*—Edward K. Look
*Assistant Examiner*—Matthew T. Shanley
*Attorney, Agent, or Firm*—Christie, Parker & Hale, LLP

[57] ABSTRACT

A fan blade mounting system for large air-moving fans includes a radially extending hub strut, a blade root member pivotally coupled to an end of the hub strut for receiving a blade skin, and a tube end located between the blade root member and the hub strut. A pair of resilient mounts are utilized in the blade root member to effectively pivotally couple the blades to the hub, thus relieving most of the vertical bending moment transferred to the hub and eliminating critical frequencies associated with the fan. The hub strut is connected to the hub of the fan by a stud having right- and left-handed threads and a wall thickness adjacent to the threads sufficient for distributing the stresses substantially uniformly on the threads, thereby improving fatigue resistance. The resilient mounts comprise a metal core and metal sleeve with a resilient elastomeric layer between the core and sleeve. The sleeves are connected to the blade root member and the cores of the two mounts are clamped to the tube end.

26 Claims, 10 Drawing Sheets

62
64
72
11
25
58
80
60
74
78
52
54
56
25
22
52
76
50
56
48

55
54
78
76
60
74
62
72
66
68
66
70
64

FAN BLADE MOUNTING

FIELD OF THE INVENTION

The present invention relates generally to large air-moving fans, and more particularly to an improved means for mounting fan blades on a rotatable hub.

BACKGROUND OF THE INVENTION

Large fans having diameters ranging from about one to ten meters or more are commonly used for moving air through cooling towers, heat exchangers and the like. A typical fan in such an application may have a diameter of about five meters and anywhere from two to eighteen airfoil shaped blades coupled to a rotatable hub. For light weight and economy, such fan blades may be fabricated from thin aluminum alloy sheets. The sheet metal is bent to provide a rounded leading edge, with the upper and lower surfaces of the blade converging toward a trailing edge where they are riveted or spot welded together. The chord line of the airfoil blade at the tip of the blade ranges anywhere from about fifteen to forty centimeters, and the maximum thickness of the airfoil ranges anywhere from about two to fifteen centimeters.

As used herein, the downstream face of the fan and blades is referred to as the upper face and the upstream face is referred to as the lower or cambered face. This is because the largest of the fans are primarily used in cooling towers or the like where they rotate about a vertical axis. Such fans are also used where the fan rotates around a horizontal axis.

Such large air-moving fans operate within a circumferentially extending shroud, which is very often not quite circular and may not be exactly concentric with the axis of the hub. Therefore, when a fan is installed, the blades and/or shroud are adjusted so that the blades clear the inside of the shroud by one or two millimeters at the closest approach, however, the blades may be about twenty millimeters (or greater) away from the shroud at the widest gap.

The blades of large fans of The Moore Company of Marceline, Mo., the assignee of the present application, are mounted to a central hub, preferably by a connection that permits limited vertical (parallel to the axis of rotation) motion. Thus, the blades may "droop" slightly when stopped, but generally extend radially from the hub during rotation. The connection between the inner ends of the blades and the hub is critical since it is a possible source for failure by fatigue cracking. Light weight and reliability are important. It is desirable to provide a mounting for blades which has minimum susceptibility to fatigue failures.

A clevis is typically used in these fans to mount the airfoil blades onto the rotatable hub. Although these fans are quite operational, there is always a need to improve the overall performance of large air-moving fans. Since one of the components of the fans that affects overall performance is the mounting of the blades, there is always a need for an improved means of fan blade mounting.

SUMMARY OF THE INVENTION

The present invention, therefore, provides an improved means of fan blade mounting, which improves the overall performance of large air-moving fans.

The fan blade mounting system according to the present invention generally includes a plurality of radially extending hub struts, a blade root member pivotally coupled to an end of each hub strut for receiving a blade skin, and a tube end insert located between each blade root member and its corresponding hub strut. A pair of resilient mounts are utilized in the blade root member to effectively pivotally couple the blades to the hub, thus relieving most of the vertical bending moment transferred to the hub and eliminating critical frequencies associated with the fan. The resilient mounts comprise a metal core and metal sleeve with a resilient elastomeric layer between the core and sleeve. The sleeves are connected to the blade root member and the cores of the two mounts are positively engaged and clamped to the tube end. A blade skin is attached to the blade root member such that the resulting airfoil blade has a substantially convex upstream face (lower face when a fan is blowing upwardly) and a substantially flat downstream face.

The hub strut is connected to the hub of the fan by a stud having right- and left-handed threads and a graduated wall thickness adjacent to the threads to distribute the stress on the thread uniformly, thereby improving fatigue resistance.

Each blade root member includes a generally cylindrical base section, an upper surface or ear extending laterally outwardly from the base section, and a lower surface or ear, spaced apart from the upper surface, extending laterally outwardly from the base section. The upper and lower surfaces of the blade root member are attached, such as by riveting, to the upper and lower faces, respectively, of a corresponding blade skin of the blade. The blade root member also includes a pair of transversely extending cylindrical bores for receiving the resilient mounts, and a notch between the cylindrical bores for receiving an end of the tube end.

The tube end is also provided with a tapered profile on its sides, for engaging a mating profile on the ends of the resilient mounts when a blade root bolt is tightened.

BRIEF DESCRIPTION OF THE DRAWINGS

These and other features and advantages of the present invention will be appreciated as the same become better understood by reference to the following Detailed Description when considered in connection with the accompanying drawings, wherein.

DETAILED DESCRIPTION

Figure 1:
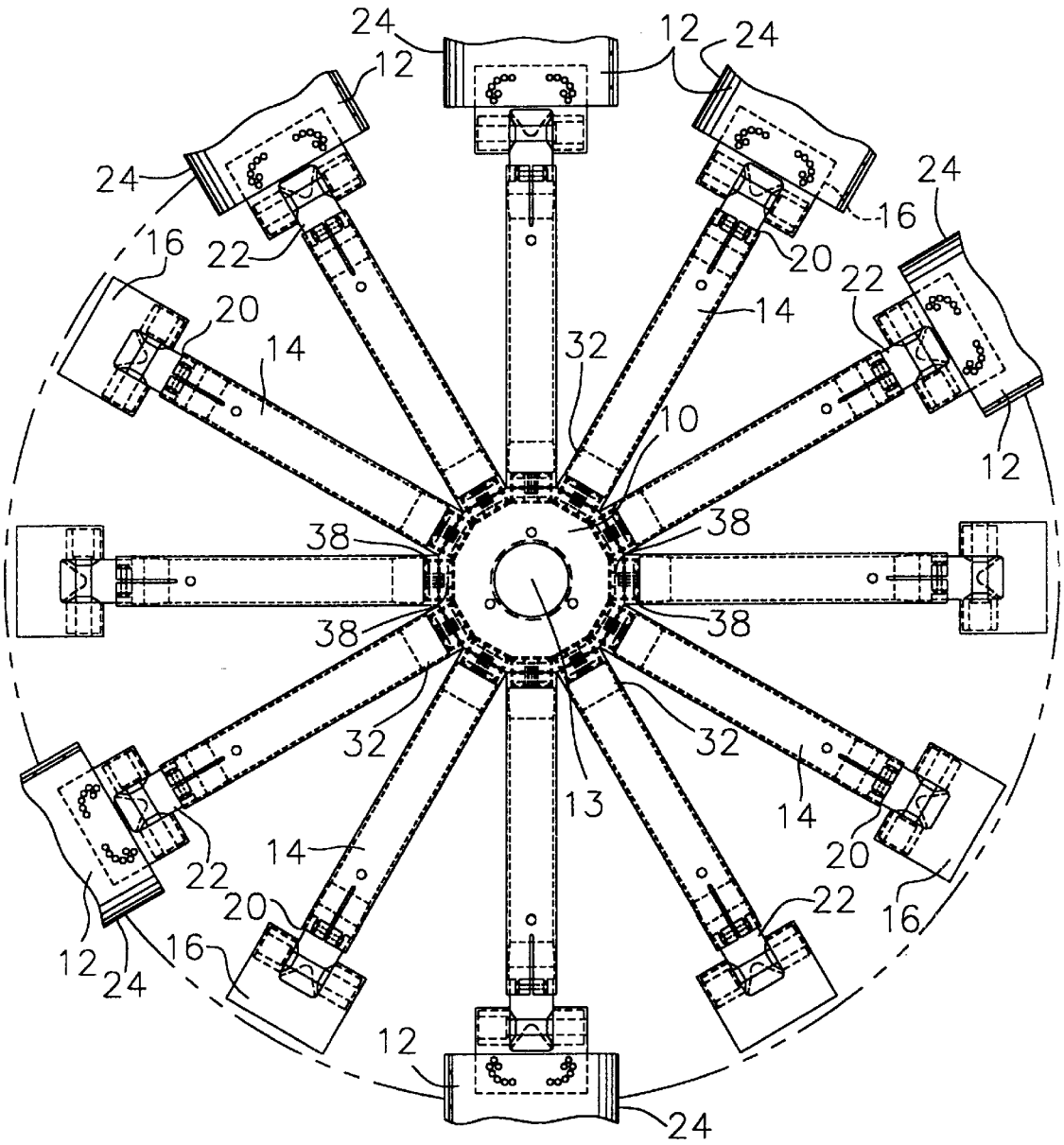
FIG. 1 is a plan view of a typical fan with a blade mounting system according to principles of this invention.

A typical large air-moving fan has a rotatable hub 10 and a plurality of generally radially extending blades 12. In the embodiment illustrated in FIG. 1, the fan is blowing upwardly from the plane of the paper and is rotating counter-clockwise. Each of the plurality of blades is coupled to the hub by a radially extending tubular hub strut 14, and a corresponding blade root member 16, for receiving an airfoil skin 18 of the blade, pivotally coupled to an outer end 20 of the hub strut. A tube end 22 is preferably provided between hub strut and the corresponding blade root member for coupling the respective components together and allowing pitch and diameter adjustment. Aluminum alloys are the preferred materials for fabricating the parts of the fan.

The blades are pivotally attached to the hub by resilient mounts 25 located at the intersection of the tube end and the blade root member. The resilient mounts are typically bushings having a rigid metal core 26 coaxial with a metal sleeve 27. A cylindrical vibration-absorbing and resilient elastomer layer 28 is between the metal core and the sleeve. The cylindrical elastomer layer in the resilient mounts allows a limited amount of rotation about an axis 11 extending through the center of the resilient mounts, yet is stiff enough to support the blades against gravity with only a slight angle of declination. As a result, when the fan is not running, the blades generally "droop" down out of a plane normal to the axis 13 of the fan due to the weight of the blades. In operation, centrifugal force causes the blades to rise to their working position in a manner similar to the blades of a helicopter. The resilient mounts as arranged firmly to resist bending moments about the axis of the fan so as to support the driving torque and any oscillating forces due to the drive or to cross-winds.

There are at least two major advantages to such a design. First, compared to fans with rigidly mounted blades, only ¼ to ½ of the stresses caused by the air load need to be supported by the blade root or are transmitted to the hub and drive, substantially increasing the life of the fan blades and the driving mechanism. Second, the resulting fan is ideally suited for operation by variable speed motors since resonant frequencies are eliminated and there are no critical speeds to be avoided. The fact that the blades are effectively hinged at the mount relieves a significant amount of the vertical bending moment transmitted to the hub.

A typical blade in such a large fan is fabricated from sheet aluminum (or aluminum alloy), with an exemplary wall thickness of about 1.5 millimeters. The sheet aluminum is bent into an airfoil shape with a generous curvature at a leading edge 24 of the blade. The edges of the sheet aluminum are brought together along a trailing edge of the blade, such that the resulting airfoil blade has a convex lower face 15 and a substantially flat upper face 17. The trailing edge 19 of the flat upper face is bent at an angle to mate with the trailing edge of the cambered lower face, where the edges are fastened together by a line of rivets 21. The balance of tho upper face adjacent to the hub is substantially flat. A flat face is employed at the inner end of the blade where it attaches to the hub to resist bending moment in the circumferential direction. Further from the inner end of the blade, curvature (either convex or concave) may be present on both the upper and lower faces of the blade. If desired in longer blades where greater stiffness is needed, a spar or other stiffening device may also be secured within the blade, or the blade may be foam filled.

Figure 4:
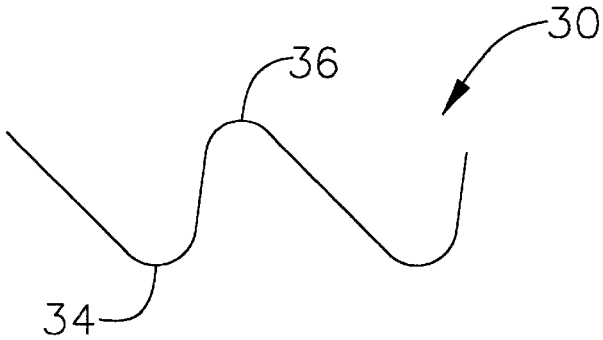
FIG. 4 is a profile of a male thread of the modified buttress thread utilized in the present invention at the junction between the hub strut and the hub.

In a presently preferred embodiment, a buttress thread 30, which has been modified to exhibit high fatigue strength, is utilized to couple the inner end 32 of the hub strut to the hub. Referring now to FIG. 4, the thread is a modified American Standard buttress profile thread, with a 7° load flank angle and a 45° relief flank angle and a 1.5 millimeter pitch. The standard buttress thread has been modified, however, by rounding off both the root 34 and the crest 36 of each thread. In an exemplary embodiment the root has a radius of about 230 micrometers and the crest has a radius of about 203 micrometers. By modifying the threads in this manner, the resulting buttress thread continues to impart relatively high levels of axial force, without imparting any appreciable radial force to the components, while gaining appreciably in fatigue strength. Additionally, the resulting buttress thread produces a strong lock between the respective components, which prevents chafing and increases overall fatigue life. The buttress threads are aligned oppositely in the hub strut so that the 7° load flank of each support the force along the thread axis.

Figure 5A:
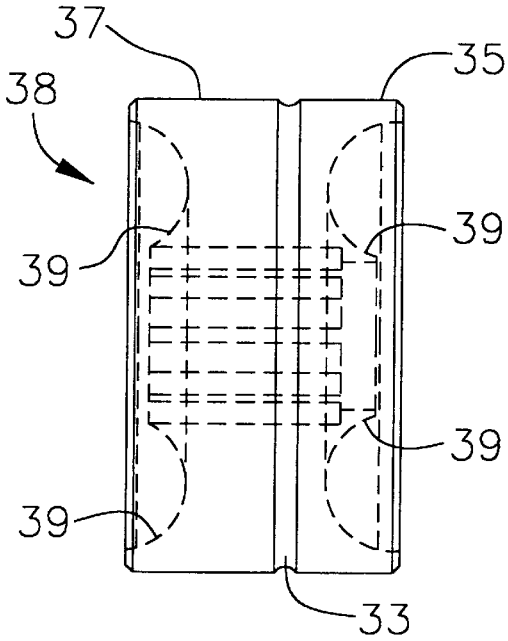
FIGS. 5A and 5B are top and side views, respectively, of the coupling member or stud utilized to couple the hub strut to the hub.
Figure 5B:
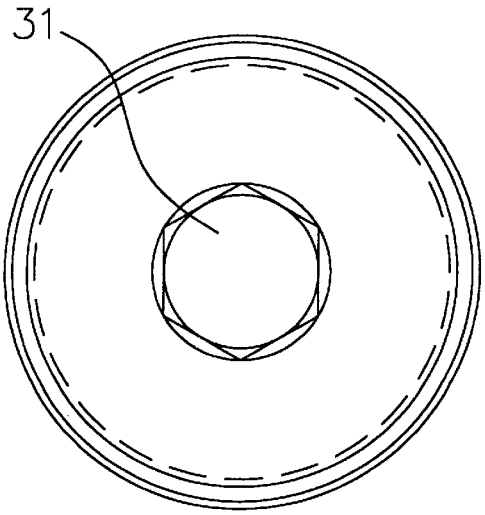
Figure 13:
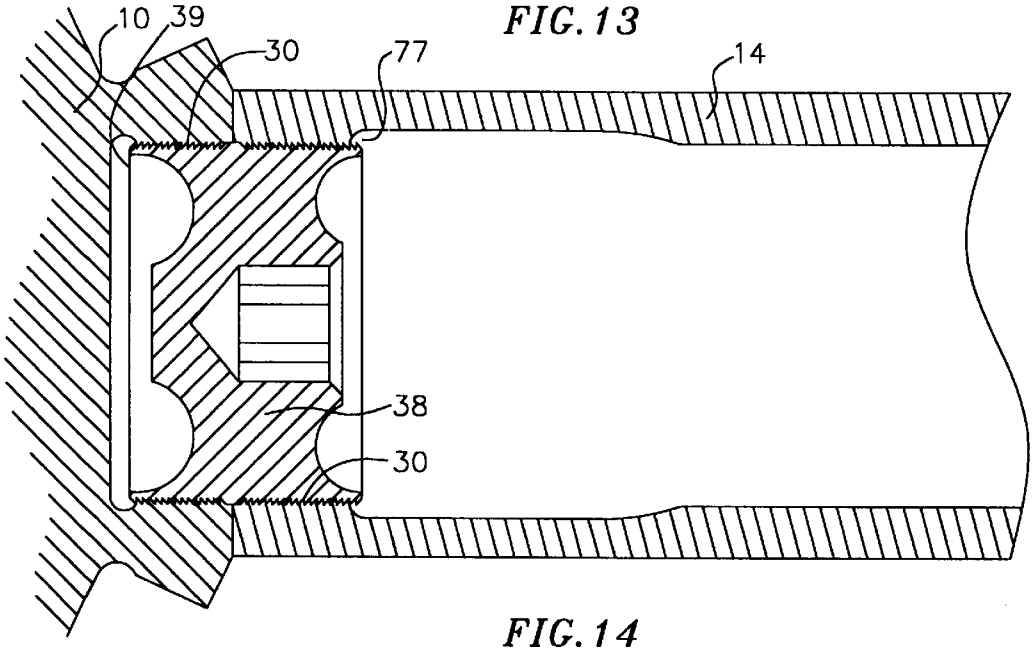
FIG. 13 is a cross-sectional view of the coupling of the hub strut to the hub.

The inner end of each hub strut and a corresponding section of the rotatable hub are internally threaded with the modified buttress thread 30 described above. The inner end of each hub strut is preferably provided with a gradual radius 77 (FIG. 13) adjacent the threads to relieve stress on the threads 30. A stud or coupling member 38 (FIGS. 5A and 5B) is provided at the inner end of each hub strut for coupling the hub strut to the hub. The coupling member is also externally threaded with the modified buttress thread 30 described above.

Preferably, the internal thread on the inner end of the hub strut is opposite the internal thread on the corresponding section of the rotatable hub (i.e. one is a left-handed thread while the other is a right-handed thread). Therefore, one end of the coupling member is externally threaded with a left-handed thread, and the other end of the coupling member is externally threaded with a right-handed thread. As a result of this design, the coupling of the hub strut to the rotatable hub may be tightened by turning the coupling member in one direction. To facilitate coupling the coupling member to the hub and hub strut, a hexagonal axial bore 31 (FIG. 5B) extends into the member.

The coupling member includes a central groove 33 between the right-hand threads and the left-hand threads, which provides some thread relief so the opposing threads do not run directly into one another. In the embodiment illustrated in FIG. 5A, the thread length on one end 35 of the coupling member is shorter than the thread length on the other end 37 of the coupling member. Preferably, the end of the coupling member with the shorter thread length is coupled to the hub, although those skilled in the art should realize that the respective thread lengths on the coupling member may alternatively be substantially equal, or the end of the coupling member with the shorter thread length may be coupled to the hub strut.

Additionally, a pair of curved recesses 39 are provided in the coupling member to act as stress distributors. The reduced and changing thickness of the stud adjacent the beginning of the thread permits deformation of the stud and thread upon tightening. The tapering wall thickness distributes a portion of the stress more or less uniformly on the threads. This reduces the stress level on the first few turns of the thread and significantly enhances fatigue resistance at the hub to strut connection.

Figure 6:
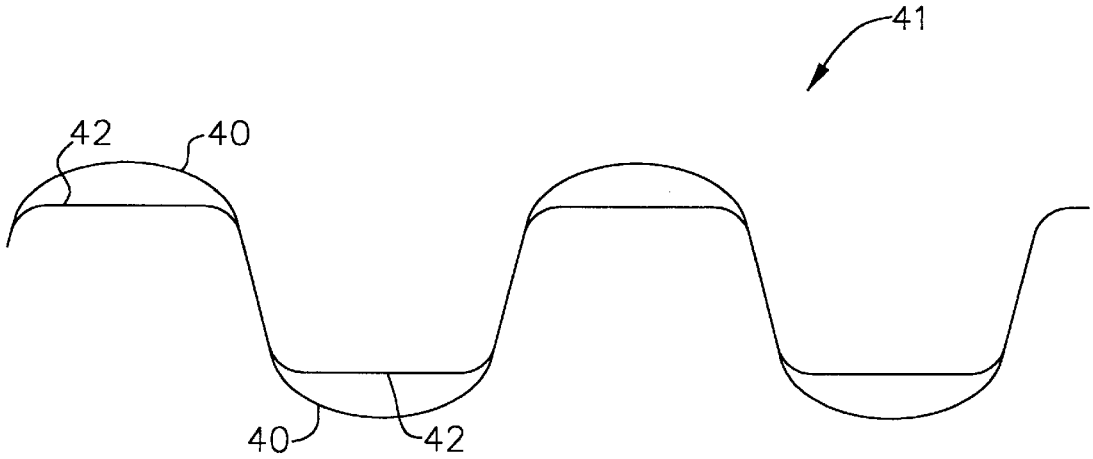
FIG. 6 illustrates a profile of a female and male thread of a modified ACME thread utilized at the junction between the hub strut and the tube end.

In a presently preferred embodiment, an ACME thread 41, which has been modified to minimize chafing and maximize fatigue life, is utilized to couple the tube end 22 to the outer end of the hub strut. Referring now to FIG. 6, the thread is a modified stub ACME profile thread, with a 29° thread angle and a 1.5 millimeter pitch. The standard ACME thread has been modified, however, by rounding off both the root 40 and the crest 42 of each thread. For example, in an exemplary embodiment illustrated in FIG. 6, a radius as high as 0.6 mm is utilized at the center of the root of each of the male and female threads.

Figure 14:
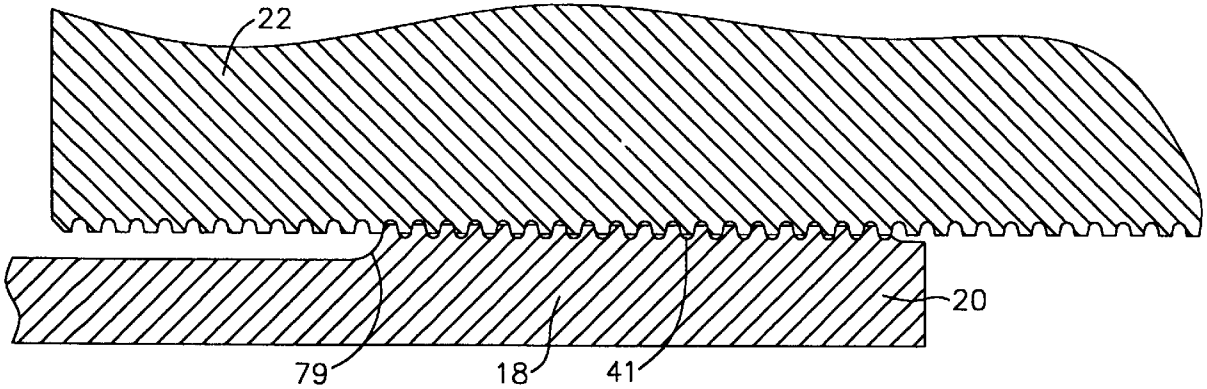
FIG. 14 is a partial cross-sectional view of the coupling of the outer end of the hub strut to the tube end.
Figure 15:
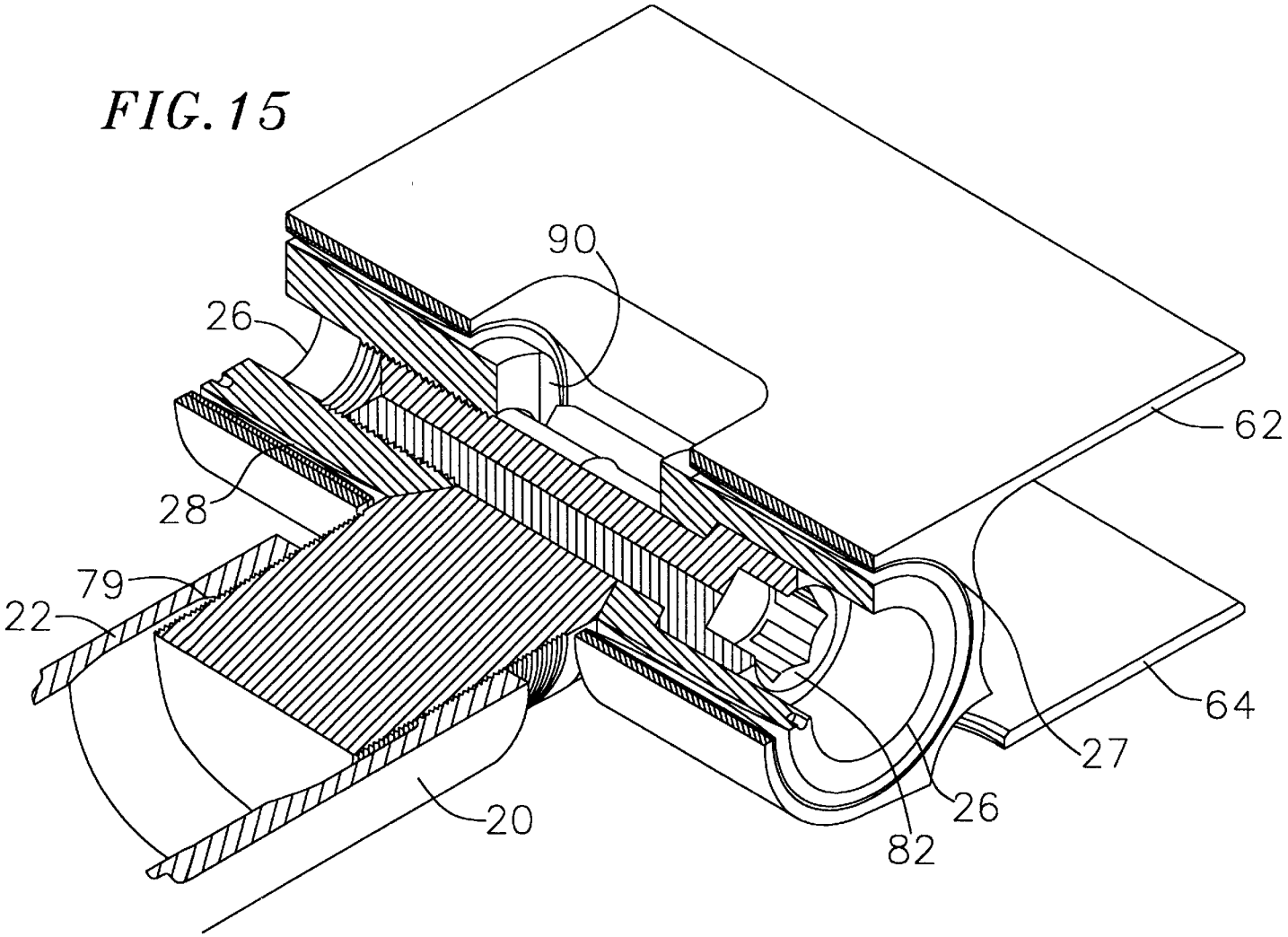
FIG. 15 is a perspective view of the blade root member pivotally coupled to the hub strut, with a section of the blade root member cut away.

The outer end 20 of each hub strut is internally threaded with the modified stub ACME thread 41 described above. The outer end of each hub strut is preferably provided with a gradual radius 79 (FIG. 14) adjacent the threads to relieve stress on the threads 41. One end 46 of each corresponding tube end is externally threaded with the modified stub ACME thread 41 described above.

Figure 2:
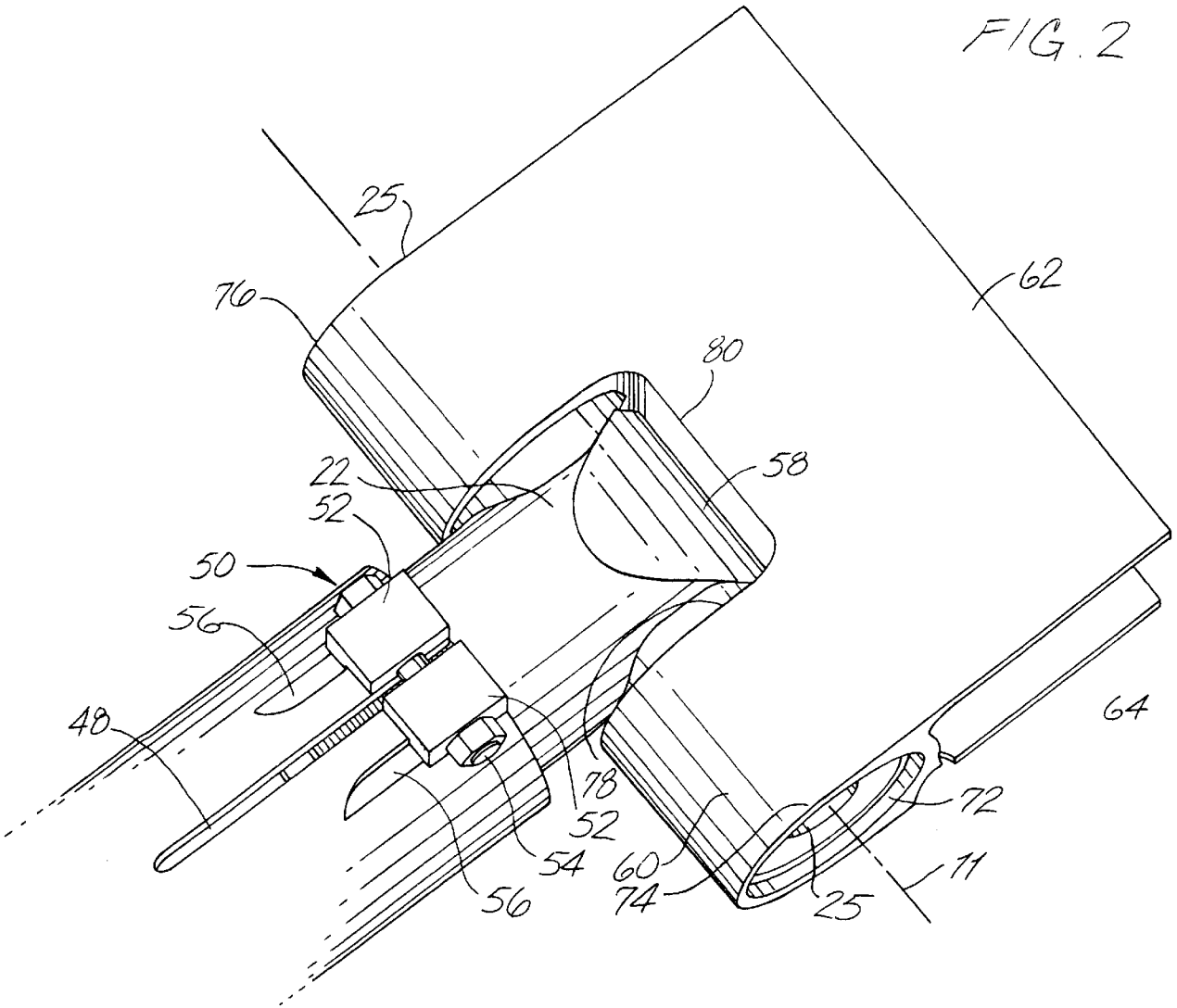
FIG. 2 is a perspective view of one of the blade mounts, comprising a hub strut, tube end, and blade root member of the fan of FIG. 1.
Figure 3:
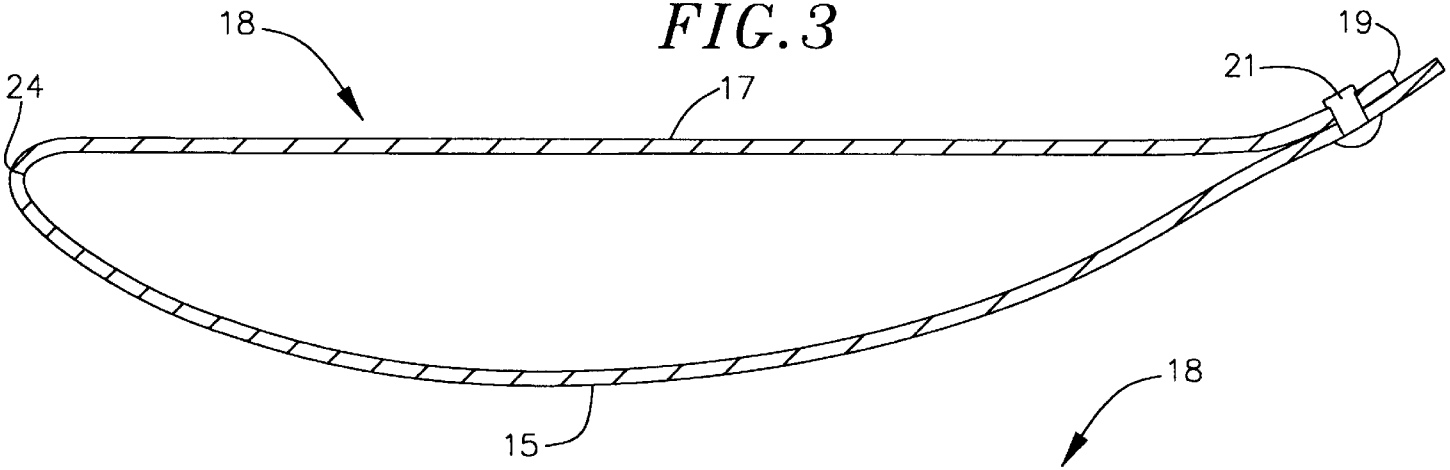
FIG. 3 is an exemplary cross-sectional view of one of the blades of the fan of FIG. 1.
Figure 8:
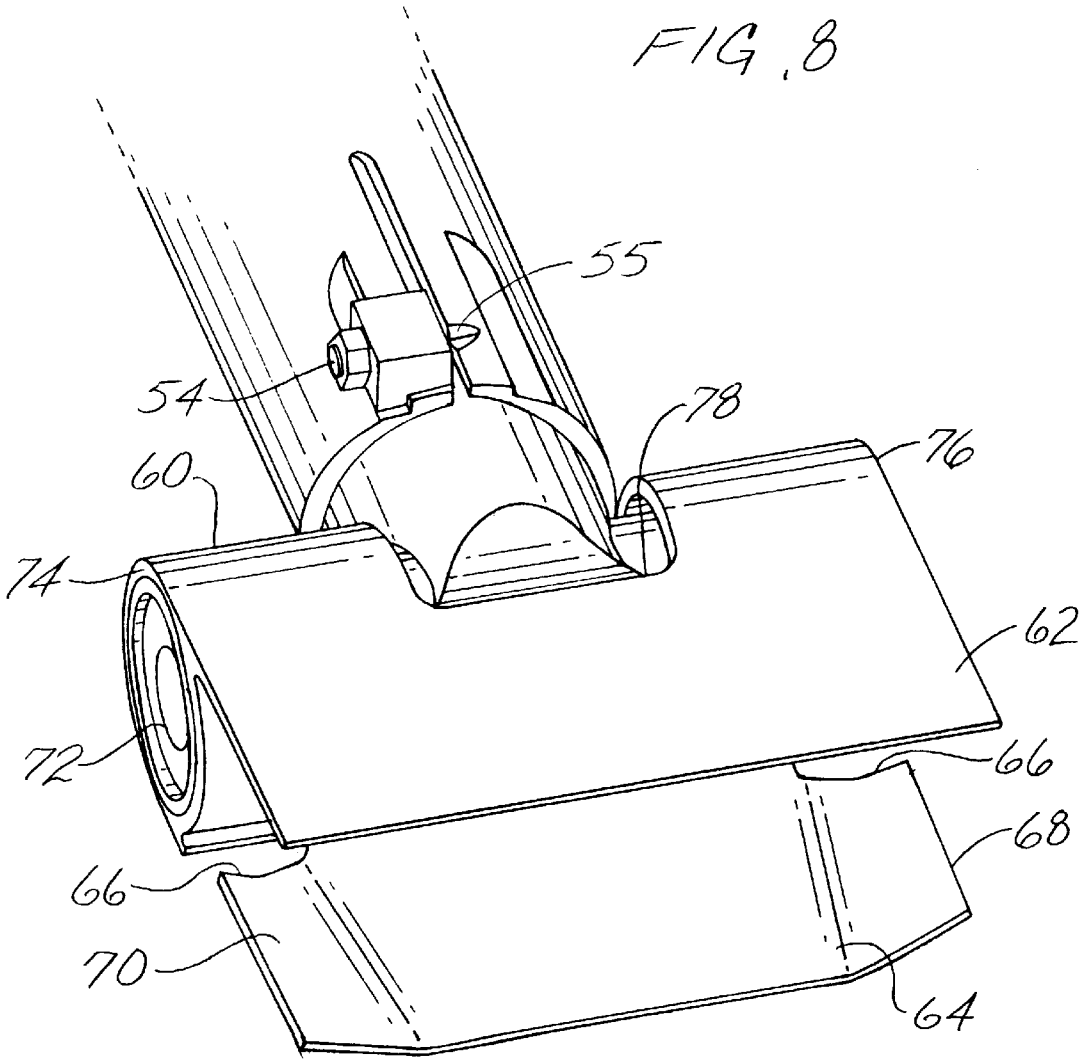
FIG. 8 is another perspective view of the blade mount of FIG. 2.

A longitudinal slot 48 and corresponding clamping means 50 are provided on the outer end of each hub strut. Once the tube end is threaded into the outer end of the hub strut, the clamping means are tightened to lock the threads 41 together more tightly, which minimizes chafing. In the embodiment illustrated in FIG. 2, the clamping means includes a pair of clamping members 52 on opposite sides of the axial slot. A fastener such as a bolt 54 extends between the clamping members transverse to the axis of the hub strut for tightening the two clamping members toward each other. Either a nut may be used (as in FIG. 2) or one clamping member may be threaded to receive a threaded end of the bolt. A longitudinal dovetail-like groove 56 (hereinafter referred to as a dovetail groove) runs along each side of the axial slot for engaging a complementary face on the lower surface of each clamping member to secure the clamping members to the hub strut. There is a shallow rounded groove 55 extending generally tangential to the wall of the hub strut (FIG. 8). An edge of the bolt between the clamping members lies in the groove, preventing the clamping assembly from flying off the end of the hub strut, if not properly tightened.

Although the present invention has been described and illustrated with a specific type of clamping means, those skilled in the art should realize that alternative means for clamping threads at the outer end of the hub strut may be utilized. For example, previously a generally U-shaped clamp similar to that used to connect a bicycle seat to the seat post has been used to clamp a split cylinder tightly about threads.

Figure 11:
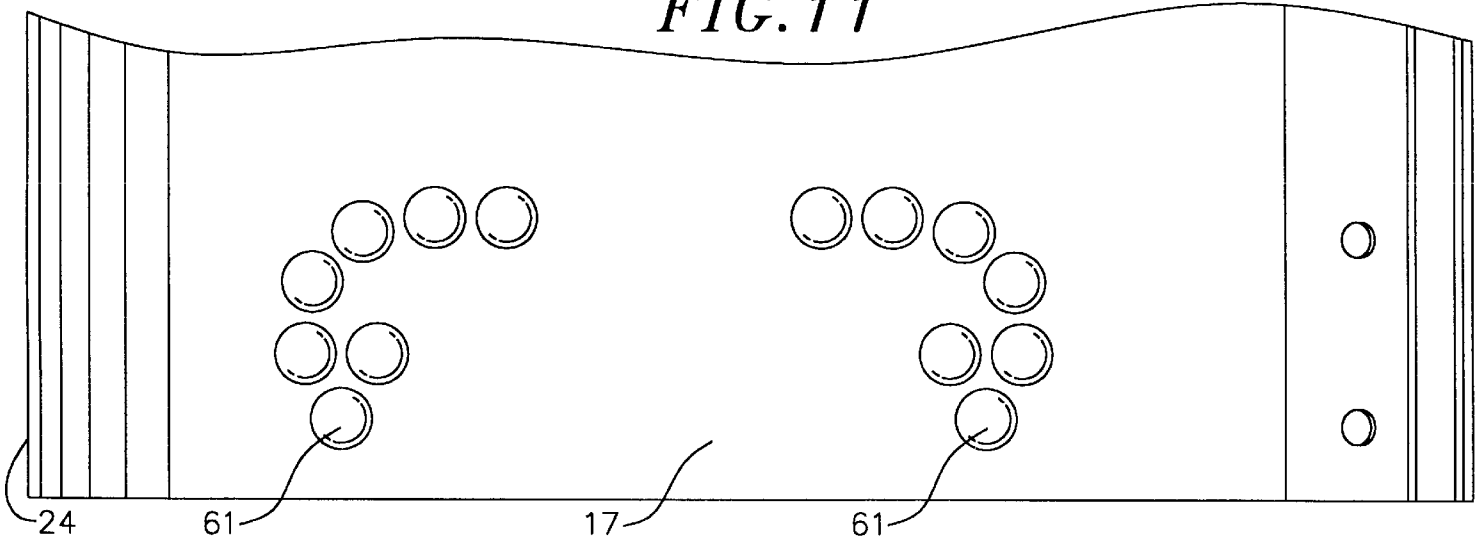
FIG. 11 illustrates an exemplary rivet pattern between a blade inner end and the blade root member.

The other end 58 of each tube end is coupled to a corresponding blade root member. Each blade root member includes a generally cylindrical base section 60, an upper surface or ear 62 extending laterally outwardly from the base section (longitudinally relative to the blade length), and a lower surface or ear 64, spaced apart from the upper surface, extending laterally outwardly from the base section. The upper and lower surfaces of the blade root member are attached, such as by riveting, to the upper and lower faces, respectively, of the corresponding side of the blade skin of the blade. An exemplary pattern of rivets 61 between the inner end of the blade and the blade root member is illustrated in FIG. 11. Such a pattern is used to distribute stresses among the rivets and in the blade skin adjacent to the rivets in order to improve fatigue resistance The blade root member may be fabricated by any method well known in the art, and is preferably fabricated from aluminum using an extrusion process.

In a presently preferred embodiment, a pair of notches 66 are formed in opposite sides 68, 70 of the lower surface of the blade root member to allow the lower surface of the blade root member to be angled as illustrated in FIG. 8 to conform approximately to the convex lower face of the blade skin. Since the notches 66 act as stress risers in the lower surface of the blade root member, and thus could adversely affect fatigue strength, they are preferably rounded at the root to minimize the stress rise at the bottom of the notches. This shaping, in combination with the design of the blade skin, allows the present invention to take advantage of the flexibility of the convex lower face of the blade skin and the rigidity of the flat upper face of the blade skin such that most of the bending moment about the fan shaft is supported on the relatively rigid upper face.

A pair of transversely extending cylindrical bores 72 are provided on opposite sides 74, 76 of the base section of the blade root member, one bore on each side of the base section for receiving a resilient mount, which may be press fit into the corresponding cylindrical bore. A wide notch 78 is provided in the center 80 of the base section, between the cylindrical bores 72, for receiving the end 58 of the tube end.

Figure 9:
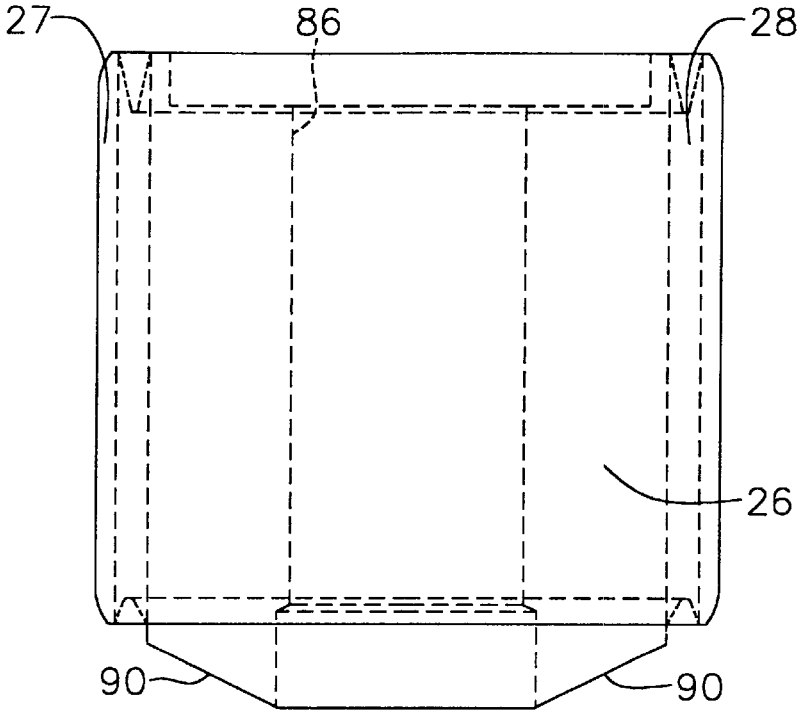
FIG. 9 is a top plan view of a resilient mount having a bore for receiving the threaded end of a blade root bolt.
Figure 10:
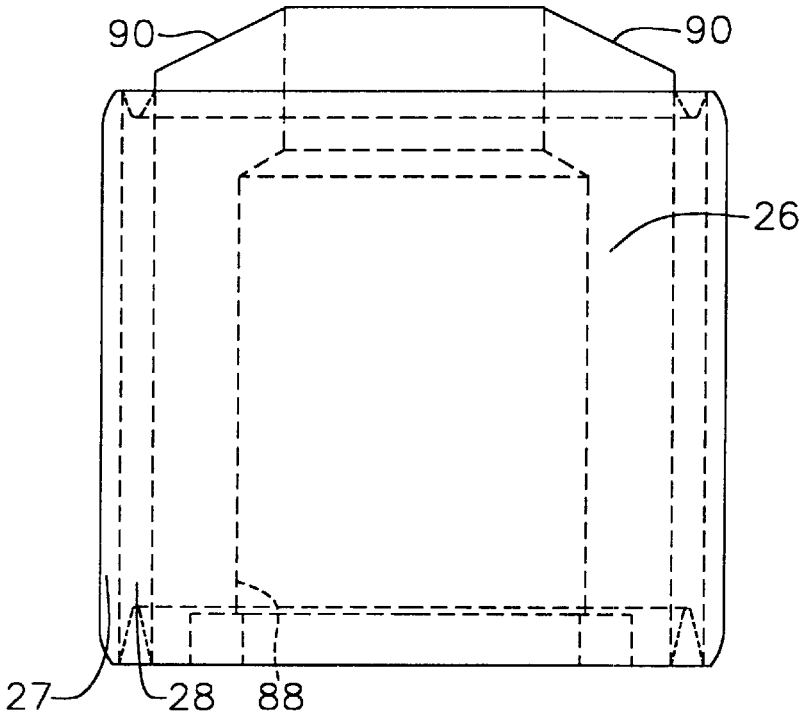
FIG. 10 is a top plan view of a resilient mount having a bore for receiving the head end of a blade root bolt.

To firmly couple the blade root member to the tube end, a blade root bolt 82 is utilized. The blade root bolt extends transversely through the blade root member, from one resilient mount, through a bore 84 provided in the end 58 of the tube end, to the other resilient mount carried by the blade root member. To receive the blade root bolt, both of the resilient mounts are provided with axially extending bores, one of the bores 86 (FIG. 9) being threaded to receive a threaded end of the blade root bolt, and the other bore 88 (FIG. 10) designed to receive the blade root bolt head.

Figure 7:
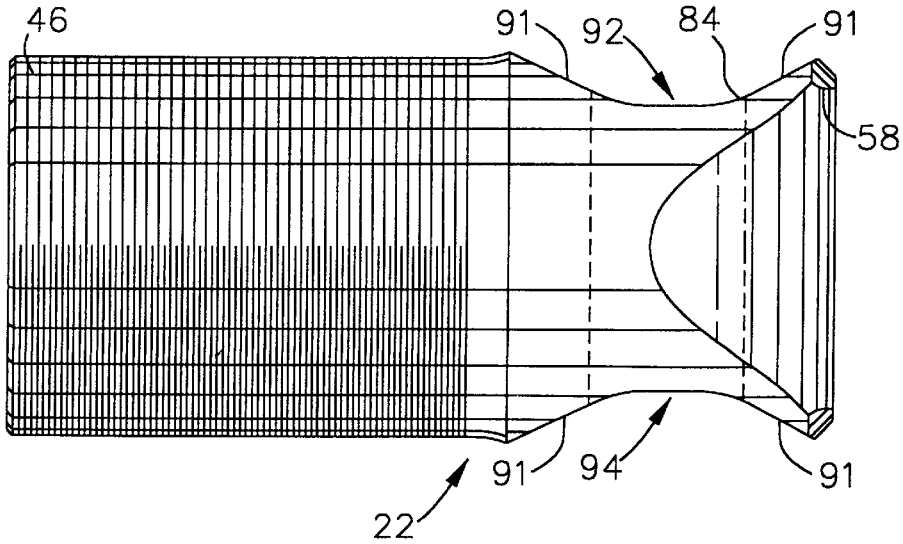
FIG. 7 is a top plan view of the tube end of FIG. 2.
Figure 12:
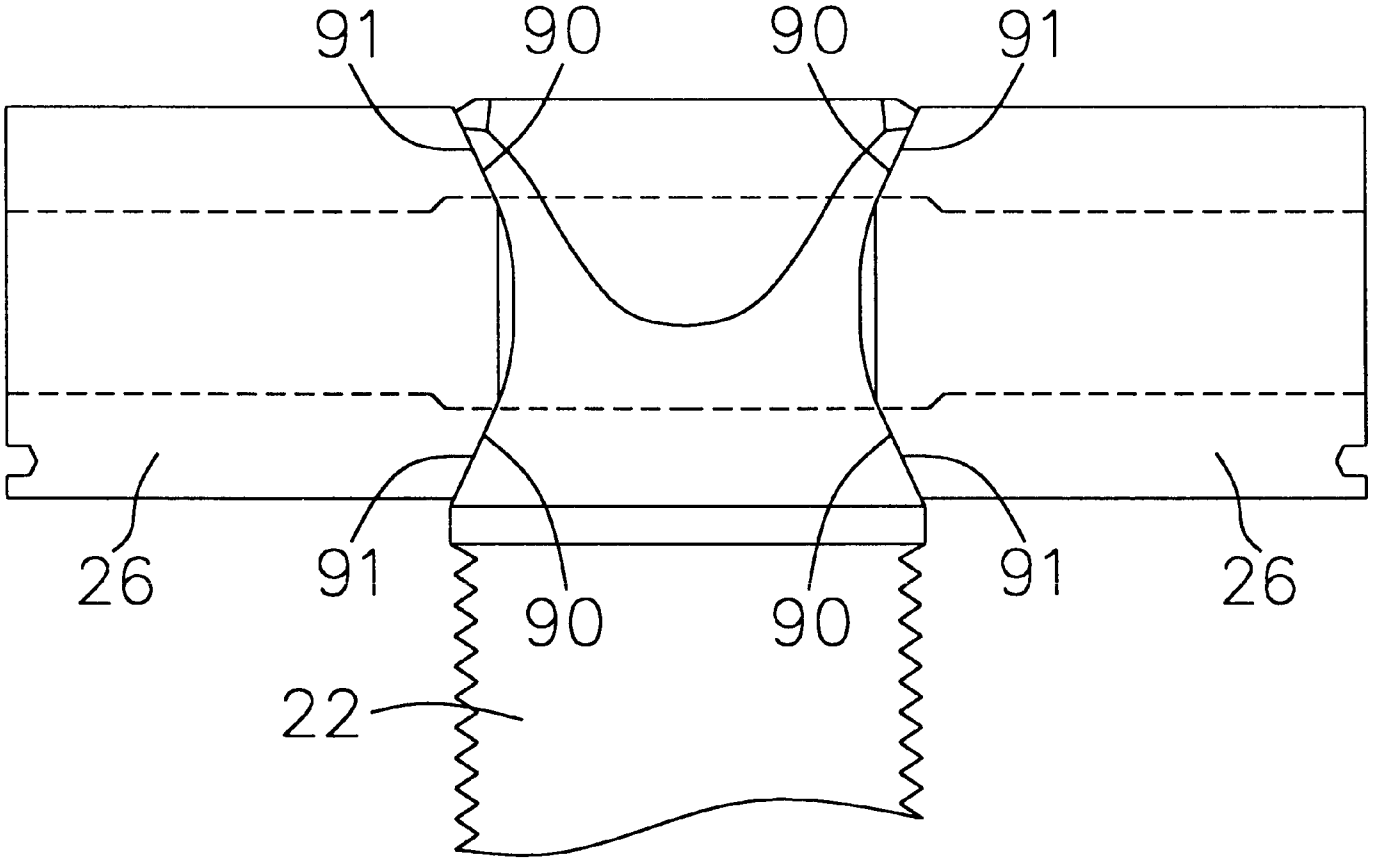
FIG. 12 is a top plan view of the mating engagement of the resilient mounts and the tube end.

The metal core or center of each resilient mount has a pair of flat tapered surfaces 90 on its interior end that engage a matching profile on the sides 91 of the end of tube end. The blade root bolt clamps the resilient mounts against the tube end when the blade root bolt is tightened so as to prevent any appreciable movement between the resilient mounts and tube end. In the exemplary embodiment illustrated in FIGS. 9 and 10, the interior end of each of the resilient mounts is beveled at an angle of about twenty-six degrees on each taper. Referring again to FIG. 7, the sides 92,94 of the tube end are tapered at a complementary angle in such a manner to tightly receive the beveled ends of the resilient mounts when the blade root bolt is tightened. As a result, the flat tapered surfaces 90 of the resilient mounts engage the matching beveled surfaces 91 of each side of the tube end (FIG. 12). This provides a positive connection between the end of the blade and the hub, as contrasted with the friction connection provided by the prior clevis mounting.

The positive connection between the blade root member and the tube end may be provided by other complementary surfaces, such as, for example, shallow grooves and ridges corrugating the opposed surfaces. A pair of complementary cylindrical surfaces may also be sufficient for preventing rotation of the resiliently mounted cores relative to the tube end. By providing a positive connection between the blade root member and the tube end, drooping of the blade is limited and one can avoid use of mechanical stops to limit the blades downward and sometimes upward travel. This is beneficial for avoiding impact forces and the resulting high stresses when the blade hits the stops, as during starting, stopping and in high cross-winds.

In the illustrated embodiment, the resilient mounts each comprise a core and sleeve with a layer of elastomer between the core and sleeve. These are press fit into the blade root member. Alternatively, one may position a core of a resilient mount within a cylindrical end of the blade root member and cast the elastomer in between the core and blade root member, thereby eliminating the sleeve.

Blades are mounted on a fan as follows: The hub struts are connected to the central hub by starting a thread of the stud into the hub then into the strut. By selectively rotating the strut and stud, the joint between the hub and strut can be positioned adjacent to the thread relief groove in the stud. The stud is then rotated via the hexagonal bore to draw the strut and hub tightly together. Finally, the tube is rotated about 60° to the desired tightened torque. The tube end is threaded into the outer end of a hub strut to approximately its final position.

Meanwhile, a blade skin has been riveted to the ears on the blade root member and resilient mounts are press fit into the two opposite sides of the blade root member. Holes or notches are provided in the outer end of each of the resilient mounts so the profiled ends of the mounts are properly oriented relative to the blade length.

It might be noted that after the elastomeric layer has been applied between the core and sleeve of a resilient mount, it is desirable to swage the sleeve after the elastomer has cured to place the elastomer in compression. If one uses an embodiment where the sleeve is eliminated and the elastomer is directly between a core and the blade root member, it may be desirable to swage the inner core outwardly after the elastomer has cured to add compression. In such case, the resiliently mounted cores may be clamped against a tube end by a nut and bolt instead of a bolt threaded into one of the cores.

The blade root member is slid over the tube end so as to straddle the outer end of the tube end, with the tapered ends of the cores of the resilient mounts aligned with the tapered profiles on the tube end. The blade root bolt is introduced and tightened to securely clamp the blade root member to the tube end. The tube end can then be rotated in the hub strut to adjust the blade length to clear the shroud of the fan, and finally when the length is proper, adjust the angle of attack of the blade for optimum efficiency. When the angle of attack is properly set, the clamp on the hub strut is tightened and installation can proceed to the next blade of the fan. A sheet metal aerodynamic hub shroud (not shown) is mounted on the hub or hub struts as an air seal at the center of the fan.

The adjustment of the blade position via the threaded tube end allows each blade to be adjusted about ±19 mm, or about ±38 mm from the nominal diameter of the fan, for clearing a shroud a desired distance. Each blade length can be adjusted to an accuracy of one half pitch of the thread.

The teachings of the present invention with respect to fan blade mounting result in a fan that is stronger and more fatigue resistant than prior art fans. For example, each of the blades on a large air-moving fan constructed according to the present invention has increased resistance to fatigue failure and blades with a chord length increased about 40% at the root and tip as compared with blades mounted with the prior clevis arrangement. This increase in effective area of the blades means, for example, that a fan can be made with 10 blades having the same aerodynamic capability as a prior fan with 14 blades. Although the cost per blade is increased, the total cost of the fan is significantly reduced.

The improved means for attaching the blades to the hub allows static and oscillating torques about the axis of rotation of about 3.2 times those of the prior design. Also, the new mount and tube end design supports the blade against gravity, unlike the prior design which required a metal "rest stop" to support longer blades when the fan was stopped. Thus, even with 40% larger blade area, the new design has about 3.2/1.4=2.28 times as much torque capacity per unit blade area. This allows the operation of fans having an area of 2.28 times that of prior fans for the same air pressures and/or allows fans to operate under equivalently more stressful conditions.

While various embodiments of this invention have been shown and described, it would be apparent to those skilled in the art that many modifications are possible without departing from the inventive concept disclosed herein. For example, although the present invention is described and illustrated in connection with certain thread types, those skilled in the art should realize that other types of suitable threads or other suitable means of coupling the respective components of the fan blade mounting system may alternatively be utilized. It is therefore to be understood that within the scope of the appended claims, this invention may be practiced otherwise than as specifically described.

What is claimed is:

1. A fan comprising:

a rotatable hub;

a hub strut coupled to and extending generally radially from the hub;

a tube end connected to the outer end of the hub strut;

a pair of resilient mounts, each mount comprising:

an inner rigid core, an outer rigid sleeve coaxial with the core, and a layer of resilient elastomer between the core and sleeve for limited circumferential motion;

means for positively clamping the cores of the resilient mounts to the tube end, wherein the inner core of each of the resilient mounts comprises a surface that when clamped against a pair of complementary mating surfaces on the tube end positively prevents rotation of the inner core both about its own axis and about the fan axis independently of friction between the mating surfaces;

a blade root member coupled to the sleeves of the resilient mounts; and an airfoil blade coupled to the blade root member.

2. A fan comprising:

a rotatable hub;

a hub strut coupled to and extending generally radially from the hub;

a tube end connected to the outer end of the hub strut;

a pair of resilient mounts, each mount comprising:

an inner rigid core, an outer rigid sleeve coaxial with the core, and a layer of resilient elastomer between the core and sleeve for limited circumferential motion;

means for positively clamping the cores of the resilient mounts to the tube end;

a blade root member coupled to the sleeves of the resilient mounts; and an airfoil blade coupled to the blade root member, wherein the blade root member comprises an upper flat surface for connection to a flat face of the airfoil blade and an angled lower surface for connection to a cambered face of the airfoil blade.

3. The fan according to claim 2 wherein the inner core of each resilient mount comprises an end surface that is not circularly symmetrical and the tube end comprises a pair of mating surfaces complementary to the end surfaces on the cores.

4. The fan according to claim 1 wherein the inner core of each of the resilient mounts comprises an end surface that is not circularly symmetrical and the tube end comprises a pair of mating surfaces complementary to the end surfaces on the cores.

5. A fan comprising:

a rotatable hub;

a hub strut coupled to and extending generally radially from the hub;

a tube end connected to the outer end of the hub strut;

a pair of resilient mounts, each mount comprising:

an inner rigid core end surface that is not circularly symmetrical, an outer rigid sleeve coaxial with the core, and a layer of resilient elastomer between the core and sleeve for limited circumferential motion, wherein the tube end comprises a pair of mating surfaces complementary to the end surfaces on the cores;

means for positively damping the cores of the resilient mounts to the tube end;

a blade root member coupled to the sleeves of the resilient mounts; and an airfoil blade coupled to the blade root member, wherein the blade root member comprises a pair of transversely extending cylindrical bores on opposite sides of the blade root member for receiving the resilient mounts, and a notch provided between the cylindrical bores for receiving an end of the tube end.

6. The fan according to claim 5 wherein each of the resilient mounts comprises an inner end beveled at an angle, and wherein the tube end has a pair of tapered sides tapered at a complementary angle, and wherein the beveled ends of the resilient mounts engage with the tapered sides of the tube end.

7. A fan comprising:

a rotatable hub;

a hub strut coupled to and extending generally radially from the hub;

a tube end connected to the outer end of the hub strut;

a pair of resilient mounts, each mount comprising:

an inner rigid core end surface that is not circularly symmetrical, an outer rigid sleeve coaxial with the core, and a layer of resilient elastomer between the core and sleeve for limited circumferential motion, wherein the tube end comprises a pair of matins surfaces complementary to the end surfaces on the cores;

means for positively clamping the cores of the resilient mounts to the tube end;

a blade root member coupled to the sleeves of the resilient mounts; and an airfoil blade coupled to the blade root member, and wherein one end of the tube end and the outer end of the hub strut are threaded for coupling the tube end to the hub strut, and further comprising clamping means on the outer end of the hub strut for securely locking the tube end to the hub strut.

8. The fan according to claim 7 wherein the means for clamping the end of the hub strut to the thread on the tube end comprises:

a slot extending longitudinally in the hub strut;

a dovetail groove along each side of the slot;

a clamping member engaging each groove with a face complementary to the dovetail groove; and a fastener extending between the clamping members for drawing the clamping members toward each other.

9. The fan according to claim 8 wherein the means for clamping the end of the hub strut to the thread of the tube end further comprises a groove extending tangentially to the hub strut for receiving an edge of the fastener.

10. A fan comprising:

a rotatable hub;

a hub strut coupled to and extending generally radially from the hub;

a threaded stud between the rotatable hub and the hub strut for coupling the hub strut to the rotatable hub, wherein one end of the stud is externally threaded with a left-handed thread and another end of the stud is externally threaded with a right-handed thread;

a tube end connected to the outer end of the hub strut;

a pair of resilient mounts, each mount comprising:

an inner rigid core, an outer rigid sleeve coaxial with the core, and a layer of resilient elastomer between the core and sleeve for limited circumferential motion;

means for positively clamping the cores of the resilient mounts to the tube end;

a blade root member coupled to the sleeves of the resilient mounts; and an airfoil blade coupled to the blade root member.

11. The fan according to claim 10 wherein the stud further comprises a recess in each end of the stud leaving a sufficient wall thickness for distributing the stresses substantially uniformly on the threads.

12. A fan comprising:

a rotatable hub;

a plurality of airfoil blades pivotally coupled to and extending generally radially from the hub; and a blade mounting system for coupling each of the plurality of airfoil blades to the hub, comprising:

a tubular hub strut coupled to and extending generally radially from the hub, a tube end threaded into the outer end of the hub strut, and a blade root member pivotally coupled to the tube end; and a blade skin connected to the blade root member, the blade skin forming a blade having a flat face attached to the blade root member and a convex face attached to another part of the blade root member.

13. The fan according to claim 12 further comprising a pair of resilient mounts in the blade root member straddling the tube end for pivotally coupling the airfoil blade to the hub strut, wherein each of the resilient mounts comprises a cylindrical elastomer layer.

14. The fan according to claim 12 further comprising a threaded stud provided between the rotatable hub and the hub strut for coupling the hub strut to the rotatable hub, wherein one end of the stud is externally threaded with a left-handed thread and another end of the stud is externally threaded with a right-handed thread.

15. The fan according to claim 14 wherein the stud further comprises a recess in each end of the stud leaving a sufficient wall thickness for distributing the stresses substantially uniformly on the threads.

16. A fan comprising:

a rotatable hub;

a plurality of airfoil blades coupled to and extending generally radially from the hub; and a blade mounting system for coupling each of the plurality of airfoil blades to the hub, comprising:

a hub strut extending radially from the hub; and a threaded stud connecting the inner end of the hub strut to the hub, having an external left-handed thread on one end of the stud and an external right-handed thread on the other end of the stud, and a recess in each end of the stud leaving a sufficient wall thickness for distributing the stresses substantially uniformly on the threads.

17. The fan according to claim 16 further comprising a blade root member connected to the outer end of the hub strut, the blade root member comprising:

a generally cylindrical portion having an axis transverse to a radial direction of the fan;

an upper ear connected to one face of a blade skin; and a lower ear connected to another face of the blade skin.

18. The fan according to claim 17 wherein one face of the blade is flat where connected to the blade root member and the other face of the blade is convex where connected to the blade root member.

19. The fan according to claim 17 further comprising:

a notch in the cylindrical portion of the blade root member;

a tube end connected between the hub strut and the notch portion of the blade root member; and a transverse bolt clamping portions of the blade root member against the tube end.

20. The fan according to claim 19 further comprising a pair of resilient mounts coaxial with the cylindrical portion of the blade root member and straddling the tube end.

21. The fan according to claim 20 wherein each resilient mount comprises:

an inner rigid core;

a sleeve coaxial with the core;

a layer of resilient elastomer between the core and sleeve for limited circumferential motion; and an end surface on each core that is not circularly symmetrical; and wherein the tube end comprises a pair of mating surfaces complementary to the end surfaces on the cores.

22. The fan according to claim 20 wherein each resilient mount comprises:

an inner rigid core;

a layer of resilient elastomer between the core and blade root member for limited circumferential motion; and an end surface on each core that is not circularly symmetrical; and wherein the tube end comprises a pair of mating surfaces complementary to the end surfaces on the cores.

23. A fan comprising:

a rotatable hub;

an airfoil blade including a blade root member at its inner end;

a hub strut coupled to and extending generally radially from the hub;

a tube end connected to the outer end of the hub strut;

a pair of resilient mounts, each mount comprising:

an inner rigid core, and a generally cylindrical layer of resilient elastomer between the core and blade root member for limited circumferential motion; and means for clamping the cores of the resilient mounts to the tube end, wherein the inner core of each of the resilient mounts comprises an end surface that is not circularly symmetrical and the tube end comprises a pair of mating surfaces complementary to the end surfaces on the cores.

24. The fan according to claim 23 wherein each resilient mount also comprises a sleeve coaxial with the core, wherein the layer of elastomer is between the core and sleeve, and the sleeve is secured to the blade root member.

25. A fan blade comprising:

a rotatable hub;

an airfoil blade including a blade root member at its inner end;

a hub strut coupled to and extending generally radially from the hub;

a tube end threaded into the outer end of the hub strut; and means for clamping the end of the hub strut to the thread on the tube end comprising:

a slot extending longitudinally in the hub strut, a dovetail groove along each side of the slot, a clamping member engaging each groove with a face complementary to the dovetail groove, and a fastener extending between the clamping members for drawing the clamping members toward each other.

26. The fan according to claim 25 wherein the means for clamping the end of the hub strut to the thread of the tube end further comprises a groove extending tangentially to the hub strut for receiving an edge of the fastener.

* * * * *

UNITED STATES PATENT AND TRADEMARK OFFICE

CERTIFICATE OF CORRECTION

PATENT NO. : 6,022,191
DATED : February 8, 2000
INVENTOR(S) : R. David Moore, John D. Moore, Joseph Parker, John E. Dowell, Kenneth E. Jay, and John P. Haynes It is certified that error appears in the above-identified patent and that said Letters Patent is hereby corrected as shown below:

Column 9,
Line 25, replace "damping" with -- clamping --.
Line 53, replace "matins" with -- mating --.

Signed and Sealed this

Second Day of April, 2002

*Attest:*

*Attesting Officer*

JAMES E. ROGAN
*Director of the United States Patent and Trademark Office*